US011192679B2

(12) United States Patent
Bautista Fernandez

(10) Patent No.: US 11,192,679 B2
(45) Date of Patent: Dec. 7, 2021

(54) FOOD CONTAINER WITH MULTIPLE COMPARTMENTS AND INCORPORATED DRINKS HOLDER

(71) Applicant: UNIVERSIDAD CONTINENTAL S.A.C., Huancayo (PE)

(72) Inventor: Gilberto Bautista Fernandez, Huancayo (PE)

( * ) Notice: Subject to any disclaimer, the term of this patent is extended or adjusted under 35 U.S.C. 154(b) by 0 days.

(21) Appl. No.: 16/971,042

(22) PCT Filed: Dec. 17, 2018

(86) PCT No.: PCT/PE2018/000034
§ 371 (c)(1),
(2) Date: Aug. 19, 2020

(87) PCT Pub. No.: WO2019/164412
PCT Pub. Date: Aug. 29, 2019

(65) Prior Publication Data

US 2021/0053718 A1 Feb. 25, 2021

(30) Foreign Application Priority Data

Feb. 20, 2018 (PE) ..... 000270-2018/DIN

(51) Int. Cl.
*B65D 5/52* (2006.01)
*B65D 5/30* (2006.01)
*B65D 5/46* (2006.01)

(52) U.S. Cl.
CPC ..... *B65D 5/5286* (2013.01); *B65D 5/302* (2013.01); *B65D 5/46128* (2013.01)

(58) Field of Classification Search
CPC .... B65D 5/5405; B65D 5/5286; B65D 5/304; B65D 5/5425
(Continued)

(56) References Cited

U.S. PATENT DOCUMENTS 3,352,053 A 11/1967 Anderson
3,754,642 A * 8/1973 Stidolph ..... B65D 5/244 206/752
(Continued)

FOREIGN PATENT DOCUMENTS

FR 1299019 * 6/1962
JP 2008056254 A 3/2008
(Continued)

OTHER PUBLICATIONS

"Empaque de mcdonalds que reduce el impacto ambiental," Web page < https://www.domestika.org/es/blog/118-empaque-de-mcdonalds-que-reduce-el-impacto-ambiental>, 1 page, Mar. 17, 2016, retrieved on Sep. 18, 2020.
(Continued)

*Primary Examiner* — Anthony D Stashick
*Assistant Examiner* — Raven Collins
(74) *Attorney, Agent, or Firm* — Mariana I. Vernieri

(57) ABSTRACT

A container for food and drink consisting of multiple compartments with an incorporated drinks holder made from a sheet comprising lateral walls with a lower support surface and an upper surface. The container consists of a main compartment with an outer face created by one of the container's side walls equipped with a rectangular opening in the middle thereof and an incorporated drinks holder on the upper surface of the container, which is an extension of one of the side walls of the container, equipped with a surrounding edge and with a cross-shaped die to form four triangles which, in turn, generate pressure upon inserting a cup. The container consists of different tabs which fit into the corresponding slots to provide stiffness, as well as different complements such as handles and die holes to incorporate different complements.

1 Claim, 7 Drawing Sheets

(58) Field of Classification Search
USPC ..... 206/45.14, 763
See application file for complete search history.

(56) References Cited

U.S. PATENT DOCUMENTS

| | | | | | |
|---|---|---|---|---|---|
| 4,757,973 | A * | 7/1988 | Rizk | F02M 59/46 251/210 |
| 5,205,474 | A * | 4/1993 | Stuart | B65D 5/5021 206/562 |
| 5,221,040 | A * | 6/1993 | Sorenson | B65D 5/6626 229/114 |
| 5,890,648 | A | 4/1999 | Cai | |
| 7,565,997 | B1 | 7/2009 | Lim | |
| 2016/0318685 | A1 * | 11/2016 | Droege | B65D 5/563 |

FOREIGN PATENT DOCUMENTS

| | | | |
|---|---|---|---|
| WO | 0172165 | A1 | 10/2001 |
| WO | 2013177239 | A1 | 11/2013 |

OTHER PUBLICATIONS

"Bellavista—Chilean Food Truck" Web page < https://www.behance.net/gallery/17154161/BELLAVISTA-Chilean-Food-Truck>, 1 page, retrieved on Sep. 18, 2020.

"Bandeja apilable para street food" Web page https://selfpackaging.es/cajas-de-carton/2525-bandeja-apilable-para-street-food-5263.html?comb-167315>, 1 page, retrieved on Sep. 18, 2020.

* cited by examiner

FOOD CONTAINER WITH MULTIPLE COMPARTMENTS AND INCORPORATED DRINKS HOLDER

CROSS-REFERENCE TO RELATED APPLICATION

This application is a national stage application, filed under 35 U.S.C. § 371, of International Patent Application No. PCT/PE2018/000034, filed on Dec. 17, 2018, which is incorporated by reference herein in its entirety.

TECHNICAL FIELD

The present invention refers to a container for food consisting of multiple compartments, which has an incorporated drinks holder that generates pressure upon inserting a cup or another type of product that may fit there. With a lower support surface, it also has a main compartment for some type of food, it also has additional inner space and an additional outer support located next to the incorporated drinks holder and several spaces in the main compartment to carry more types of food or other objects such as napkins, straws, or utensils in single containers, allowing the consumer to carry it with one hand in a more stable way.

It is found in the technical field of food transport items and more specifically of holders of edible products and drinks.

BACKGROUND OF THE INVENTION

Currently, there is a variety of cardboard packaging the merchandising of fast food such as food trucks, fast food centers, etc. and the accustomed on-the-go consumption of many people due to the accelerated change of the pace of life. In different places, this is more common and frequent, in places of mass concurrence such as hospitals, universities, educational centers, shopping centers, etc.

There is also patent ES1078899, titled "FOOD CONTAINER COMPRISING A DRINK SUPPORT", which refers to a food container that comprises an adapted accessory to support a cup. This way, since the cup and food are located in the same container, the customer can carry everything with only one hand or arm. Nevertheless, the disadvantage that this "FOOD CONTAINER COMPRISING A DRINK SUPPORT" presents is that when being taken by the cup, it doesn't have an insulation in case the drinks get cold or hot depending on the season of the city where the product is sold, creating the fear of suffering a burn accident, or of the drink being spilled and eventually wasted. Likewise, if the cup used does not have a high resistance, given the movements that take place when carrying it, said drink could overspill and get the hands dirty.

Since the container and the adapted accessory to support the cup are not static, when either the substance of the container or of the accessory for the cup is placed on a flat surface, it may overflow and generate a hygienic problem and discomfort in said person. This being said, the consumption in this container for drinks will only be through a straw, since the cup couldn't be taken to drink from it directly (cup and mouth) and even if it could, the client would have to use both hands and it would be complicated to return the cup to its place vertically, since the drink accessory would lean given that it is a loop, taking the risk of being dropped given the difficulty of carrying it all together.

This way, the usual technique is to use the trays or cardboard boxes, where they do not have a stable compartment, carrying food or snacks of two or three on top of others and if they are accompanied by a drink these trays cannot transport them there, generating considerable discontent in a majority of people, not because of how bad the food may be, but because of the way they are merchandised and delivered for consumption. In many cases occupying both hands, incurring an unpleasant moment and creating the fear of suffering a burn accident, getting dirty, spilling or in the end wasted generating superior discomfort when consumed in that way.

However, the need and lack of a product that allows food to be carried comfortably and safely to eat on the go has been identified, including maintaining good manufacturing practices.

SUMMARY OF INVENTION

The present invention refers to a container for food with multiple compartments with an incorporated drinks holder.

The container allows to carry the food items without the problem of spilling drinks or food. Likewise, it has additional spaces which allow that the content is organized and also has some items that are used to consume the food, because the incorporated cups holder gives greater stability and is adapted to be used in different product lines.

As a solution to the above-mentioned problems, the present invention was developed. This food container with multiple compartments and incorporated drinks holder effectively and efficiently attains the stability and balance of the food items (drinks accompanied with some other appetizer) at the moment of consuming them while one is moving due to walking or to transport movements without the risk of spilling, getting dirty or wasting the food. That the food remains in the container (its place) for as long as the people consider it necessary between one section and another.

The present invention refers to a container for food with multiple compartments with an incorporated drinks holder, in which the incorporated drinks holder located in the smaller base has an upper surface with a surrounding sub-edge and some cuts and die-cut from corner to corner which, by breaking them, generate four triangles, creating a pressure and stability when inserting a cup or another type of product that may fit there and the main compartment in the longer base for some type of food, allowing the consumer to carry the container for food with multiple compartments with an incorporated drinks holder with one hand in a more ergonomic way.

It should be noted that more inner or outer divisions could be added to the compartments in order to carry more types of food, supplies or other items such as napkins, straws or some utensil for consumption.

Moreover, the container comprises:

Vertical tabs on the left and right edges of the parallel side walls, located in the direction of the sides of the side walls of the smaller base and the longer base to later be attached or inserted into a vertical slot located in a joining area on the vertical sides of the side walls of the smaller base and the longer base in order to generate greater consistency.

Two tabs located at the top of the parallel side walls with little distance of the corners of the smaller base in order to be inserted into a slot located in the middle of the folding line, between the "A"-tab and the upper surface of the container.

The incorporated drinks holder has an upper surface of the container that is an extension of the side wall of the smaller base, equipped with conditioning of a surrounding sub-edge and die-cut, as well as a cut and die-cut crossed from corner to corner, materializing four triangles that generate pressure when inserting a cup or another type of product that may fit there.

Continuing with the incorporated drinks holder, it is equipped with a spine from corner to corner, with a slit in the middle to insert the thumb, being located at the top in one of the side walls of the smaller base. It should be noted that this condition (spine) is not essential in the operation of the invention. However, this feature is considered in the largest range of containers for food with multiple compartments with an incorporated drinks holder for generating better ergonomics when transporting it.

Likewise, on the lower surface it has a system of multiple vertical die-cuts at the height of incorporated drinks holder in order to prevent the fingers from slipping when picking up the transportable container.

Depending on the assembly, the separating face becomes a next extension of the upper surface of the container, equipped with some "F"-tabs located on the left and right side and a "D"-tab in the middle of the outer edge of said separating face, which, when entering into the container, is inserted into a snap-in hole located on the lower surface, to maintain the consistency of the incorporated drinks holder and the main compartment. Likewise, it should be mentioned that the lower support surface of the entire invention is closed except for the snap-in hole.

Depending on the basic specifications of the invention mentioned above, a variety of the container for food with multiple compartments with an incorporated drinks holder are derived, for all kinds of use in the Food Truck area, fast food centers, establishments that sell food on-the-go, restaurants, cinemas, theaters, pastry, events and domestic use.

It is important to note that the use of the container for food with multiple compartments with an incorporated drinks holder is not exclusive to a single type of food and that its variety or model does not have a limited number.

It should be noted that these seven characteristics apply to the elaboration of all ranges of the invention. Likewise, the figures show continuous lines for the die-cut and discontinuous lines for folding.

1. It has vertical tabs on the left and right edges of the parallel side walls, located towards the sides of the side walls of the smaller base and the longer base so they can be glued or inserted into a vertical slot of the joining area, located on the vertical sides of the side walls of the smaller base and the longer base to generate greater consistency.
2. In the incorporated drinks holder there is an upper surface in the container that is an extension of the side wall of the smaller base, conditioned by a surrounding and die-cut sub-edge, it also has a cut and die-cut from corner to corner, materializing four triangles that in turn generate pressure when inserting a cup or another type of product that may fit there.
3. The separating face becomes another extension of the upper surface of the container, containing "F"-tabs located on the left and right side and a "D"-tab in the middle of the outer edge, which when entering the container is inserted into a snap-in hole located in the bottom surface to maintain consistency.
4. It comprises two tabs located at the top of the parallel side walls a short distance from the corners of the smaller base to be introduced into a slot located in the middle of the folding line, between the "A"-tab and the upper surface of the container.
5. Likewise, on the lower surface it has a system of multiple vertical die-cut at the height of the incorporated drinks holder in order to prevent the fingers from slipping when picking up the transportable container.
6. In relation to the structure of the container for food with multiple compartments with incorporated drinks holder, the varieties and elevations change according to the foods to be considered or any other input wished to be included or added in these spaces.
7. The incorporated drinks holder also considers a compartment for a cup or other type of product that may fit there.

This means an improvement in the state of the art since it creates an insulation, a resistance and a larger compactness in the entire container at the time of introducing the drinking cup or another product accompanied by some food.

DETAILED DESCRIPTION AND BEST MODE OF IMPLEMENTATION

Figure 1:
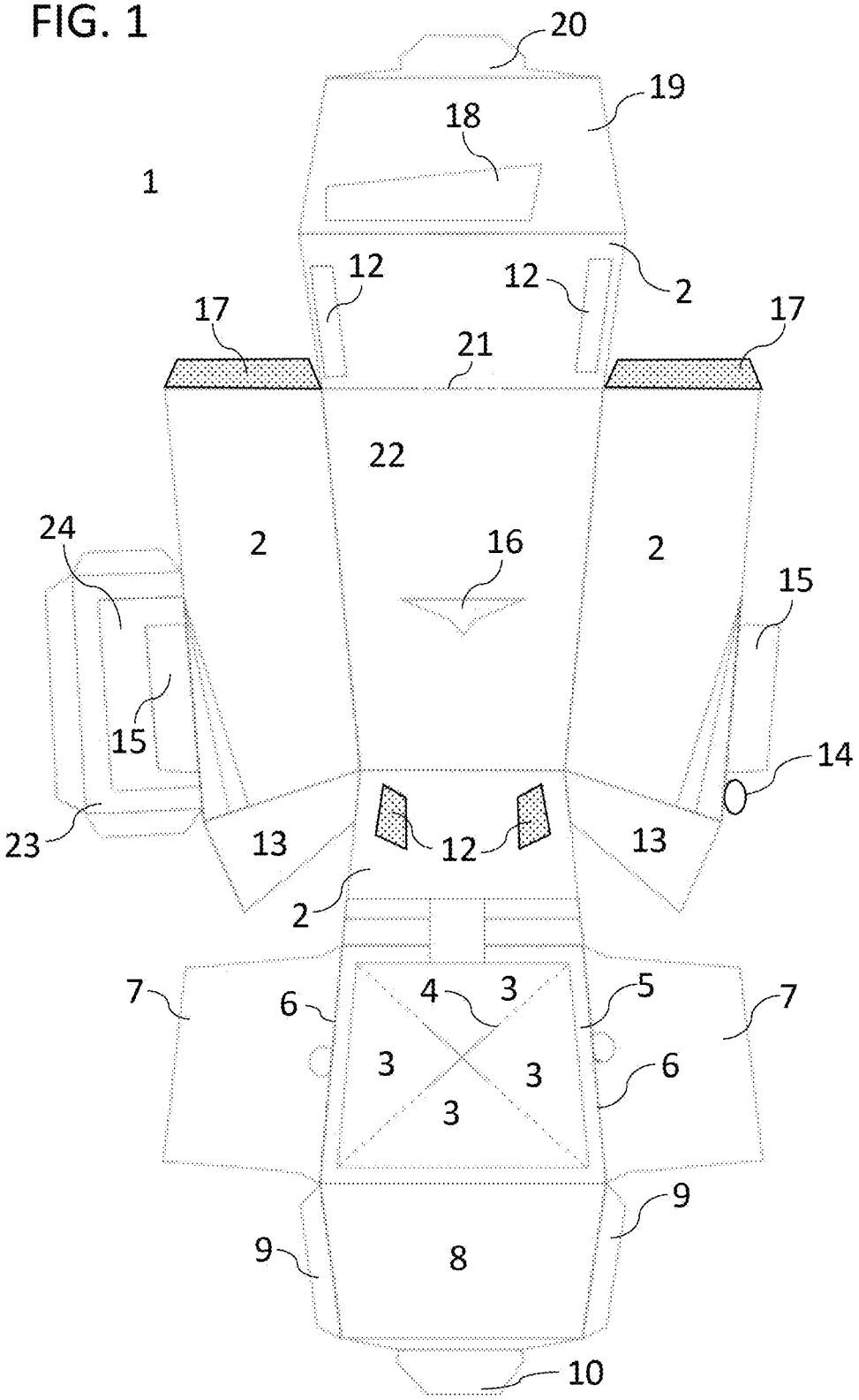
FIG. 1 is a top view of the extended plane of an unfolded embodiment of a container with multiple compartments and incorporated drinks holder in accordance with the present invention.

Disclosed is a container with multiple compartments and incorporated drinks holder. Some general aspects, of the present invention have been summarized so far in the previous sections of this disclosure. Hereinafter, a detailed description of the invention as illustrated in the drawings will be provided. While some aspects of the invention will be described in connection with these drawings, it is to be understood that the disclosed embodiments are merely illustrative of the invention, which may be embodied in various forms. The specific materials, methods, structures, and functional details disclosed herein are not to be interpreted as limiting. Instead, the intended function of this disclosure is to exemplify some of the ways—including the presently preferred ways—in which the invention, as defined by the claims, can be enabled for a Person of Ordinary Skill in the Art. Therefore, the intent of the present disclosure is to cover all variations encompassed within the spirit and scope of the invention as defined by the appended claims, and any reasonable equivalents thereof.

The specific references that, together represent the total assembly of the invention according to FIGS. 1 to 7 are detailed below:

1. Container.

Name given to the entire aimed structure of the invention.

2. Side walls.

Referring to the lateral walls of the invention.

3. Upper surface.

It corresponds to the incorporated drinks holder, where the first cut and die-cut system 4 is located, which allows a sort of pressure and stability when introducing the cup 32 or another product.

4. First Cut and die-cut A.

Located on the upper surface 3 of the first compartment, to generate pressure and stability by introducing a cup 32 or something else.

5. Sub-edge.

The entire die-cut it is located on the upper surface 3 surrounding the first Cut and die-cut 4.

6. "A"-slots.

These "A"-slots A 6 located in the middle of the folding line, between the "A"-tabs 7 and the upper surface 3 of the container.

7. "A"-tabs.

It is located on the sides of the upper surface 3 of the container, located inside when assembling the container, generating greater resistance and compactness.

8. Separating face.

Extension of the upper surface 3 and it is possible to place it between the smaller base and longer base, which when assembled it divides the container 1 into more compartments.

9. "F"-tabs.

Being on the vertical side of the separating face 8 they are fulfilling the function of resistance and compactness.

10. "D"-tab.

By dividing the separating face 8 of the main compartment of the container 1, this "D"-tab D 10 is inserted into the snap-in hole 16 of the lower support surface generating more consistency.

11. Slit.

Located in the smaller base, space in the middle of the spine 25 of the upper surface 3 in which a thumb can be inserted for a better grip of the container 1.

12. Joining area.

Located in one of the side walls 2 of the smaller base at medium height, they fulfill the function of helping the right "B"-tabs 17 and the left "B"-tabs 13 of the two parallel side walls 2 to stick or be inserted into a slot for the assembly of the container 1.

13. Left "B"-tabs.

It creates a resistance for the upper surface 3 of the container in the incorporated drinks holder, also has a gluing or embed in a slot located in the joining area 12 for the assembly of the container 1.

14. External accessory.

It fulfills the function of being able to carry a sorbet or some straight utensil.

15. "C"-tabs.

Located at the top of the two parallel side walls 2 a short distance from the corners of the smaller base to be introduced into "A"-slots 6.

16. Snap-in hole.

It is to allow that "D"-tab 10 located in the middle of the edge of the separating face 8 is inserted into said snap-in hole 16.

17. Right "B"-tabs.

It fulfills the function of gluing or embedding in a slot located in the joining area 12 of one of the side walls 2 of the longer base for the assembly of the container 1.

18. First Rectangular Hole.

Space conditioned for napkins or some input that is considered convenient.

19. Outer face.

It is an extension of one of the side walls 2 engaging inside the main compartment 33. Where the First Rectangular Hole 18 for napkins or other supplies is also located.

20. "E"-tab E.

Located in the middle of the outer edge of the outer face 19 which is then inserted into the inner slot 21 when the outer face 19 is coupled inside the container 1.

21. "B"-slot.

Slot where the "E"-tab 20 of the outer face 19 is inserted so that it is not loose.

22. Lower support surface.

It is the entire lower support surface 22 of the container, characterized by being flat, except for a snap-in hole 16 and the rest is closed.

23. Outer support.

Space where it is possible to add some boxes containing potato chips, native chips, tequeños or any other spices for consumption.

24. Second Rectangular Hole B.

It is the empty part in the middle of the outer support 23.

25. Spine.

Named spine because of its shape and it helps to have a greater ergonomic grip, located in the corner of the smaller base of the upper surface 3 of the container 1.

26. Second Cut and die-cut.

Sub edge of cut and die-cut on the upper surface 3 of the inner compartment 27 that generates pressure when inserting any food or any other considered input.

27. Inner compartment.

Generated on the side of the upper surface 3 of the incorporated drinks holder to add some food or accessories to eat the food.

28. Multiple die-cut.

Located on the lower support surface 22 at the height of the incorporated drinks holder, with multiple horizontal die-cut. Its purpose is preventing the fingers from slipping when picking up the container 1.

29. Side walls extension.

It is an extension of the side wall 2. They fulfill the function of carrying the container 1 as a box or as a sort of hag, due to the shape of handles used.

30. Third Rectangular Hole C.

They are holes in the two mini handles 31 to insert the fingers of the hand and carry the container 1 as a box stably.

31. Mini handles.

They are grab handles that are designed to transport the container 1 taken from these mini handles 31 as a kind of bag.

32. Cup.

Utensil to carry any drink.

33. Main compartment.

Main compartment located in the longer base.

Referring to each one of the drawings in more detail, FIG. 1 shows a top view of the extended plane of the container for food with multiple compartments with incorporated drinks holder. It has four side walls 2 of the isosceles trapezoid type throughout the container 1. Likewise, the entire lower support surface 22 is closed except for the snap-in hole 16. A sub-edge 5 on the upper surface 3 is also shown, which has a first cut and die-cut 4 from corner to corner and at the time of introducing a cup or a similar item four triangles are generated when breaking, which create greater pressure and stability to the cup. On one of the side walls 2 of the main compartment there is an extension of an outer face 19 with a First Rectangular Hole 18 to fill a napkin or some complementary ingredient and an "E"-tab 20. In addition, an accessory is generated in the upper part of one of the parallel side walls 2, called the outer support 23 and in the middle a Second Rectangular Hole 24, to be able to move for example boxes with potato chips or native chips, tequeños, spices. etc. Also notice that in one of the parallel side walls 2 an external accessory 14 is extended to fit a type of sorbet or a straight utensil such as spoon, etc.

The container 1 comprises two "C"-tabs 15 on the top of two of the parallel side walls 2 a short distance from the corner at the height of the incorporated drinks holder to insert said "C"-tabs 15 into the "A"-slots 6 located in the middle of the folding line, between the "A"-tabs 7 and the upper surface 3 of the container 1. It also has a separating face 8 which is an extension of the upper surface 3 that adds "F"-tabs 9 and a "D"-tab 10 in the middle of the edge of the separating face 8 which is inserted into the snap-in hole 16 of the container 1. FIG. 1 also shows a Joining area 12, two left "B"-tabs 13, two right "B"-tabs 17, and a "B"-Slot 21.

Figure 2:
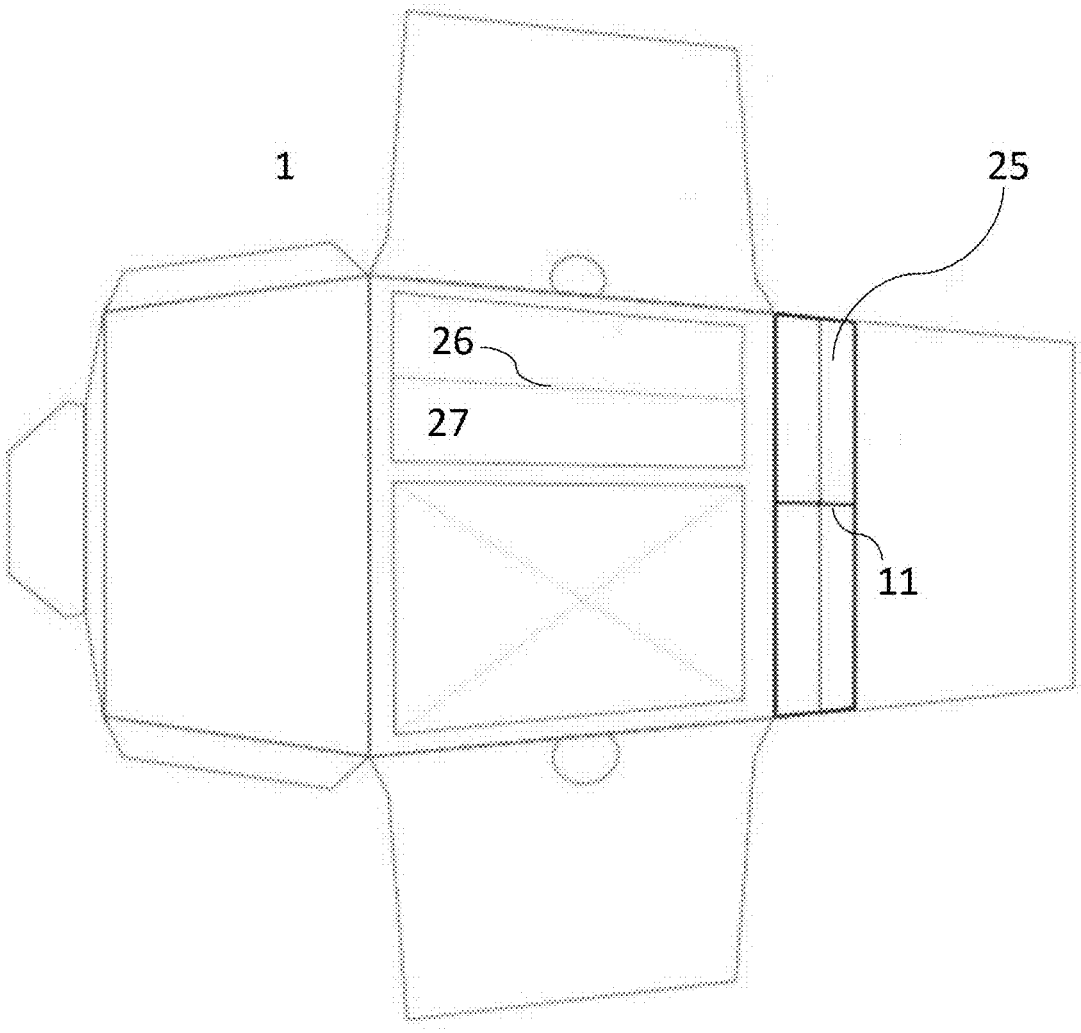
FIG. 2 is a top view of the upper surface portion of the extended plane of an unfolded embodiment of a container with multiple compartments and incorporated drinks holder in accordance with the present invention.

As shown in FIG. 2, in a flat plane, at the height of the upper surface 3, it can be seen that a spine 25 is generated at the smaller base from corner to corner and in the middle of it there are two row cuts at the height of the spine 25 creating a slit 11 to insert the thumb, for better control and grab of the container. FIG. 2 also shows a second Cut and die-cut 25 and an inner compartment 27.

Figure 3:
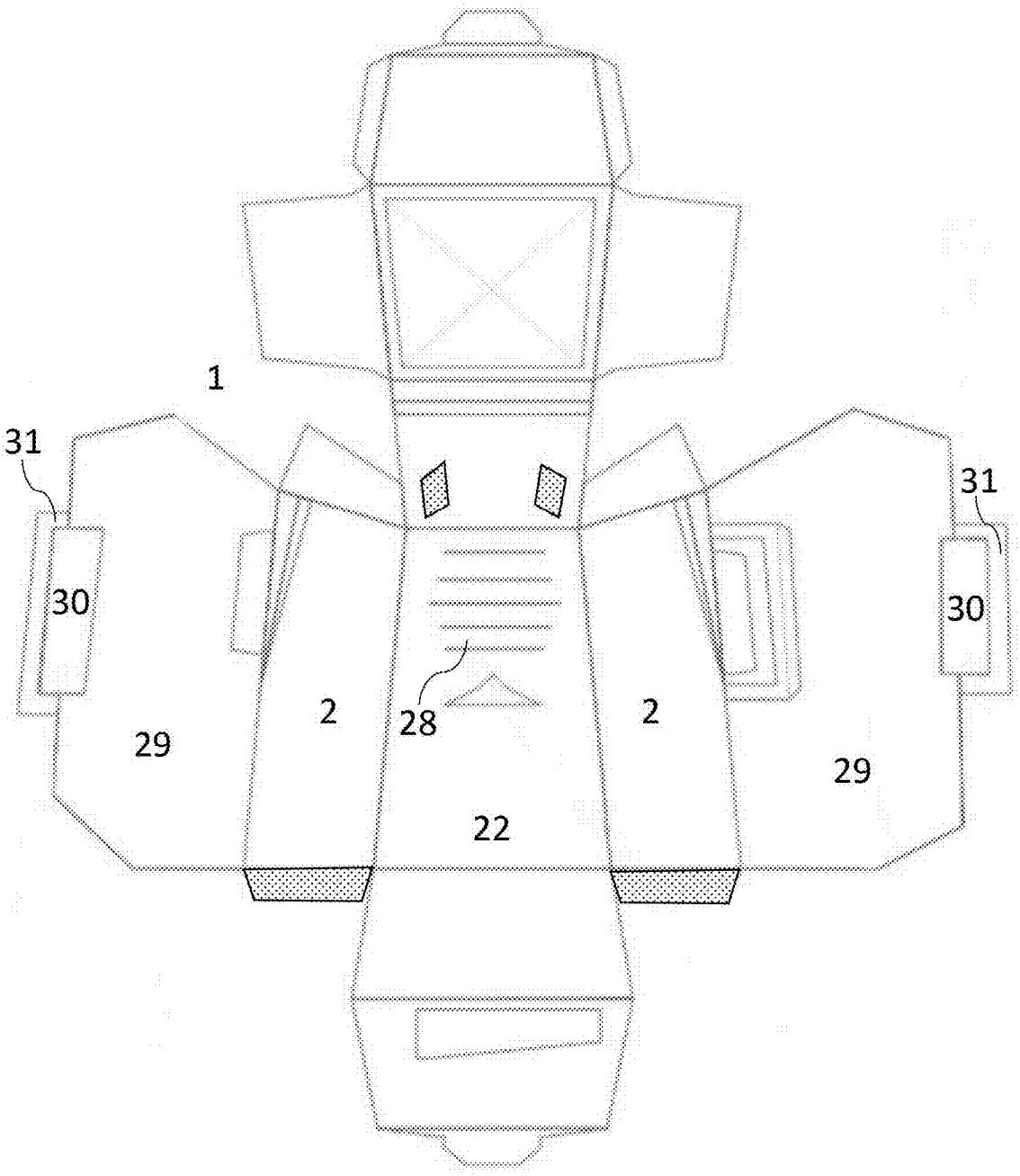
FIG. 3 is a top view of the extended plane of another unfolded embodiment of a container with multiple compartments and incorporated drinks holder in accordance with the present invention.

FIG. 3 illustrates a vertical system of multiple die-cuts 28 on the lower support surface 22 of the smaller base in order to prevent the fingers from slipping when the container 1 is held. In this way, characterized by considering a side walls extension 29 of the side walls 2, and above this side walls extension 29 are some mini handles 31 in the middle of each parallel side wall 2, and side wall extension 29, with a Third Rectangular Hole 30 where the fingers fit to carry them in a comfortable way.

Figure 4:
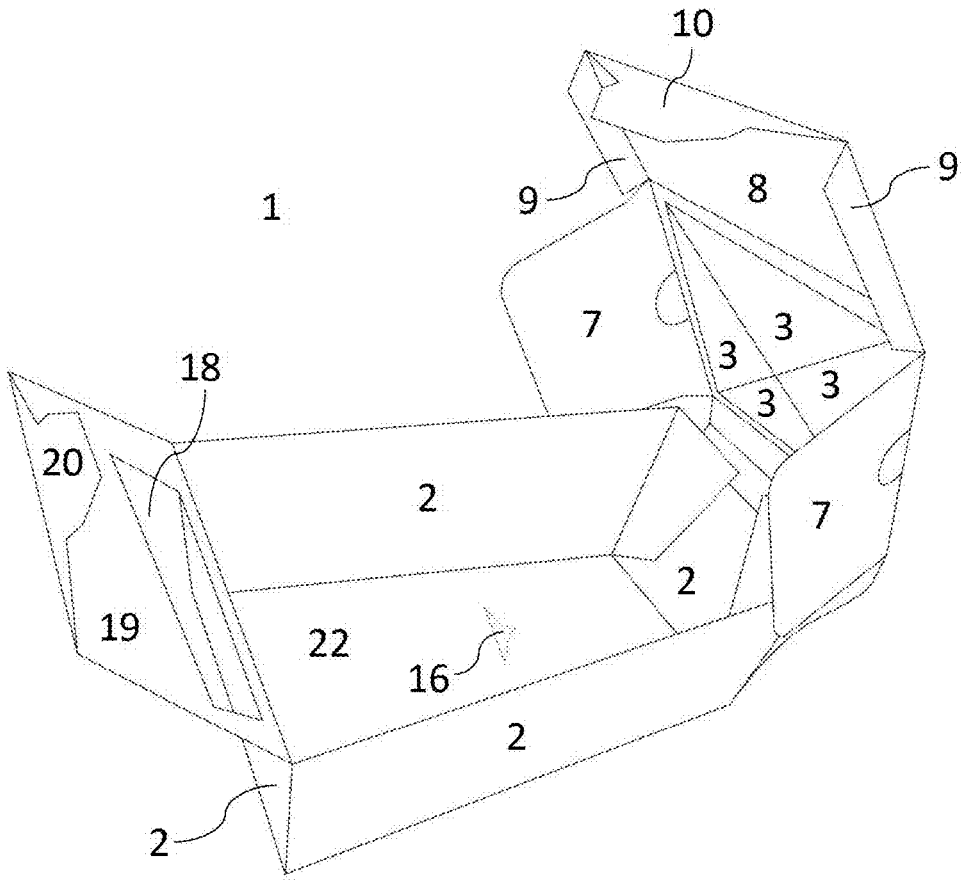
FIG. 4 is a perspective view of a partially folded embodiment of a container with multiple compartments and incorporated drinks holder in accordance with the present invention.

FIG. 4 is seen from a left side view, the assembly of the container attaching the side walls 2. Likewise, the outer face 19 is visible on the left side, which is an extension of one of the side walls 2 of the longer base, also having a First Rectangular Hole 18 to include some utensil or considered input. Thereupon, on the right side, the incorporated drinks holder which has an upper surface 3 with "A"-tabs on the sides and a separating face 8 that has "F"-tabs 9 on the sides for greater consistency when assembling the container can be seen. Continuing with FIG. 4, the snap-in hole 16 is seen in the lower support surface 22 to insert there the "D"-tab 10 of the separating face 8. Two "A"-tabs 7, an outer face 19, and an "E"-tab 20 are also shown.

Figure 5:
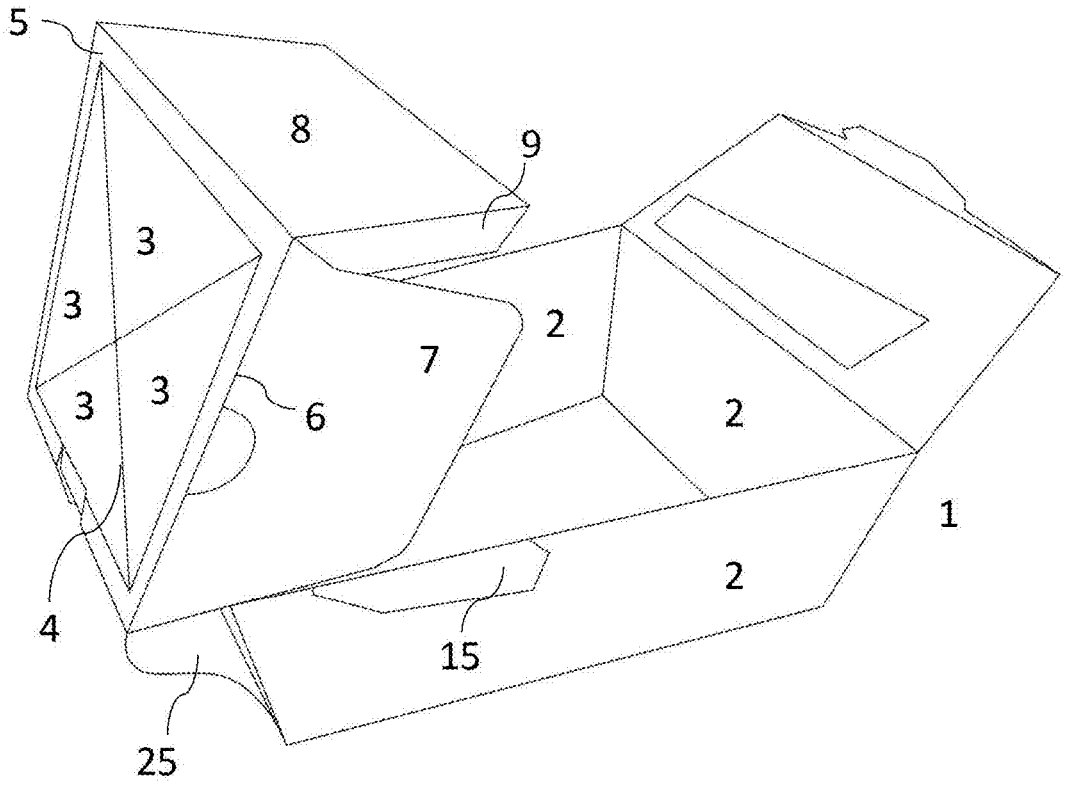
FIG. 5 is a perspective view of another partially folded embodiment of container with multiple compartments and incorporated drinks bolder in accordance with the present invention.

As shown in FIG. 5, from a left side view, the incorporated drinks holder which has an upper surface 3 and "A"-tabs A 7 on the sides can be seen. Similarly on the upper surface 3 there is a system of first cut and die-cut 4 crossed from corner to corner, materializing four triangles that generate pressure when inserting a cup or another type of product that may fit there. It also has an extension of the upper surface 3 called the separating face 8 which has "F"-tabs 9 on the left and right sides for greater consistency when assembling the container.

Likewise, the spine 25, which helps to obtain a better grip on the container is seen. Also, notice some "C"-tabs 15 on the top of one of the side walls 2 that are inserted in the "A"-slots 6 located in the middle of the folding line, between the "A"-tabs 7 and the upper surface 3 of the container 1. A sub-edge 5, a first rectangular hole 18, an outer face 19, and a lower support surface 22 are also shown.

Figure 6:
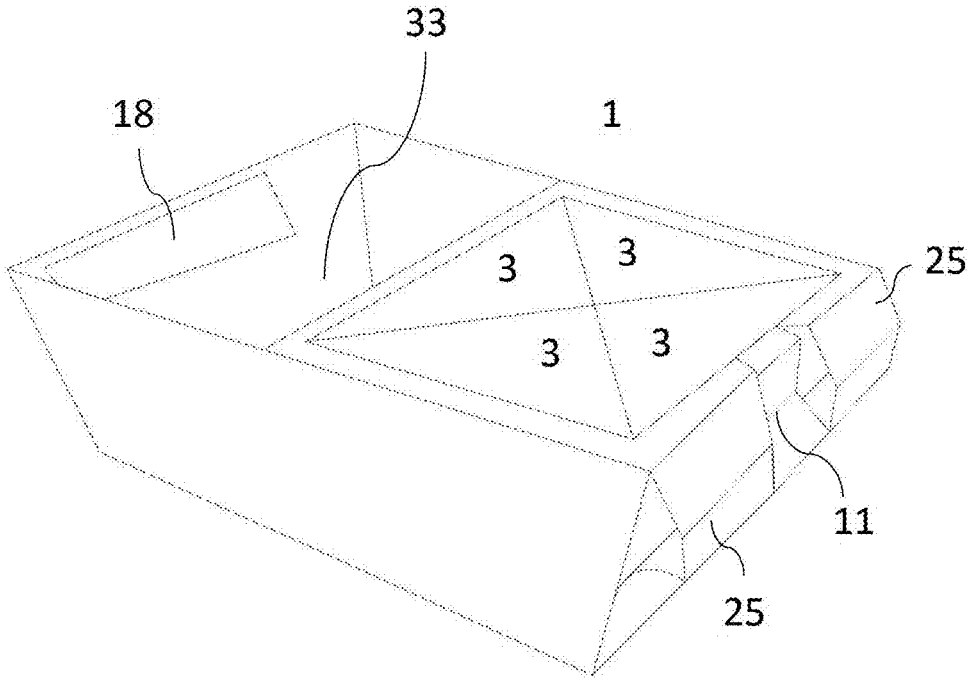
FIG. 6 is a perspective view of an embodiment of a folded container with multiple compartments and incorporated drinks holder in accordance with the present invention.

In FIG. 6 an assembled container can be seen from a right side view. What is indicated in FIG. 2 is shown in more detail, it shows that at the height of the upper surface 3, a spine 25 is generated at the smaller base from corner to corner and in the middle of the spine 25 it has two row cuts at the height of the spine 25 creating a slit 11 to insert the thumb, for greater control and grip of the container 1. The figure also shows the side walls 2, a sub-edge 5, a first rectangular hole 18 and a main compartment 33.

Figure 7:
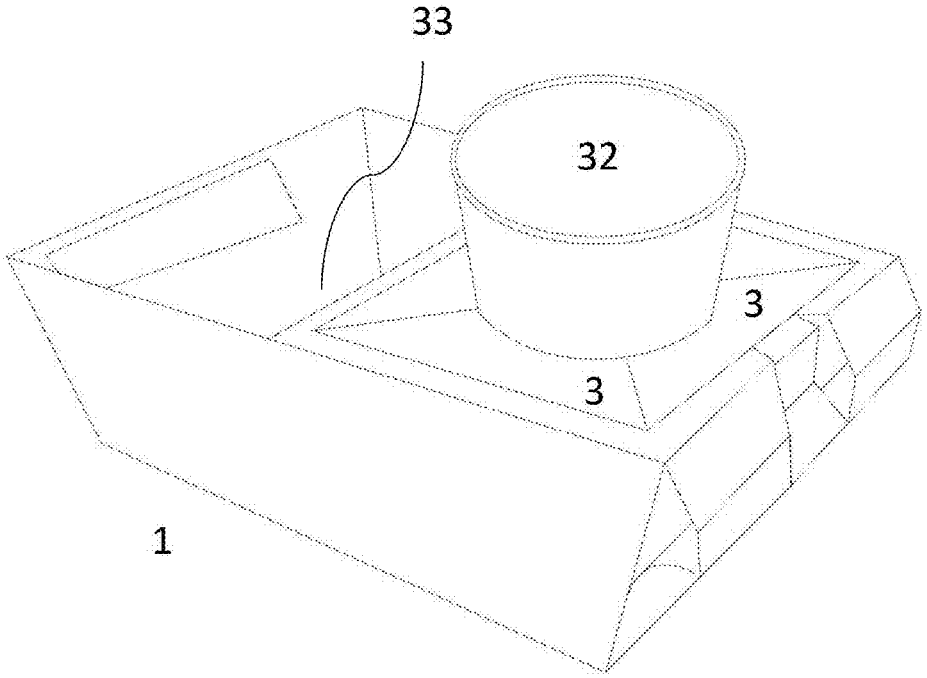
FIG. 7 is a perspective view of an embodiment of a folded container with multiple compartments and incorporated drinks holder in accordance, with the present invention, holding a cup on its upper surface.

Finally, FIG. 7 shows, from a right side view, the operation of the incorporated drinks holder, in this case with a cup 32 being located on the upper surface 3 of the smaller base. Also a main compartment 33 in the longer base to add any type of food or considered input. Moreover, the figure shows the side walls 2, a sub-edge 5, a slit 11, a first rectangular hole 18 and spine 25.

Assembling in this way the container for food with multiple compartments with an incorporated drinks holder that will fulfill the above-mentioned function.

These are some forms of assembly of the container for food with multiple compartments with an incorporated drinks holder. That said, we detail below 17 varieties of the invention.

S1.1 Simple Double Container

Container for food with multiple compartments with an incorporated drinks holder, included to have a uniform height across the surface.

S2.2 Ergonomic Single Source Container

Container for food with multiple compartments with an incorporated drinks holder, characterized by considering a compartment with a larger surface area for food or snacks such as salchipapas, etc. Likewise, at the height of the upper surface, a spine is generated at the smaller base from corner to corner and in the middle of the spine it has two row cuts at the height of the spine, creating a slit to insert a finger, so that at the moment of grabbing the container one gets better ergonomics when transporting it.

S3.3 Ergonomic Chinese Food Container

Container for food with multiple compartments with an incorporated drinks holder, characterized by considering a compartment with a larger surface area and being oriented at foods such as chaufa rice or similar to these or any other type of considered input in that container. Likewise, at the height of the upper surface, a spine is generated at the smaller base from corner to corner and in the middle of the spine it has two row cuts at the height of the spine, creating a slit to insert a finger, so that at the moment of grabbing the container one gets better ergonomics when transporting it.

D4.1 Ergonomic Double Container

Container for food with multiple compartments with an incorporated drinks holder, characterized by considering a uniform height across the entire surface of the container. Likewise, at the height of the upper surface, a spine is generated at the smaller base from corner to corner and in the middle of the spine it has two row cuts at the height of the spine, creating a slit to insert a finger, so that at the moment of grabbing the container one gets better ergonomics when transporting it.

D5.2 Ergonomic Double Oval Container

Container for food with multiple compartments with an incorporated drinks holder, ergonomic, characterized by having semi-oval parallel side walls giving it a different design when building, the container. Likewise, at the height of the upper surface, a spine is generated at the smaller base from corner to corner and in the middle of the spine it has two row cuts at the height of the spine, creating a slit to insert a finger, so that at the moment of grabbing the container one gets better ergonomics when transporting it.

D6.3 Flat Surface Ergonomic Double Container

Container for food with multiple compartments with an incorporated drinks holder, ergonomic, characterized by the main compartment having a minimum height across the entire surface to facilitate the consumption of food such as cake slices, etc. Likewise, at the height of the upper surface, a spine is generated at the smaller base from corner to corner and in the middle of the spine it has two row cuts, at the height of the spine, creating a slit to insert a finger, so that at the moment of grabbing the container one gets better ergonomics when transporting it.

D7.4 Ergonomic Simple Source Double Container

Container for food with multiple compartments with an incorporated drinks holder, ergonomic, characterized by considering a large-sized compartment for consumption of salchipapas, snacks, etc. Likewise, at the height of the upper surface, a spine is generated at the smaller base from corner to corner and in the middle of the spine it has two row cuts at the height of the spine, creating a slit to insert a finger, so that at the moment of grabbing the container one gets better ergonomics when transporting it.

D8.5 Ergonomic Chinese Food Double Container

Container for food with multiple compartments with an incorporated drinks holder, ergonomic, characterized by considering equal sized compartments. Likewise, at the height of the upper surface, a spine is generated at the smaller base from corner to corner and in the middle of the spine it has two row cuts at the height of the spine, creating a slit to insert a finger, so that at the moment of grabbing the container one gets better ergonomics when transporting it.

T9.1 Ergonomic Triple Outer Container

Container for food with multiple compartments with an incorporated drinks holder, ergonomic, characterized by having an outer compartment, an empty outer support accessory in the middle that is generated from one of the parallel side walls at the height of the smaller base of the container, generating a space to be able to transport, for example, boxes with fries or native chips, tequeños, or spices. etc. In that way the side wall of the longer base has an extension of an outer face which is coupled to the inside of the longer base container, said attached face also has a rectangular hole to fill the napkin or complementary ingredients. Likewise, at the height of the upper surface, a spine is generated at the smaller base from corner to corner and in the middle of the spine it has two row cuts at the height of the spine, creating a slit to insert a finger, so that at the moment of grabbing the container one gets better ergonomics when transporting it.

T10.2 Ergonomic Triple Inner Container

Container for food with multiple compartments with an incorporated drinks holder, ergonomic, characterized by containing a double compartment next to the incorporated drinks holder, it also considers a uniform height across the entire surface of the container. In that way the side wall of the longer base has an extension of an outer face which is coupled to the inside of the longer base container, said attached face also has a rectangular hole to fill the napkin or complementary ingredients. Likewise, at the height of the upper surface, a spine is generated at the smaller base from corner to corner and in the middle of the spine it has two row cuts at the height of the spine, creating a slit to insert a finger, so that at the moment of grabbing the container one gets better ergonomics when transporting it.

T11.3 Ergonomic Triple Outer Container with Handles

Container for food with multiple compartments with an incorporated drinks holder, ergonomic, characterized by considering an elevation at a double height proportion of the parallel side walls, consequently, in the middle of this elevation a mini handle is considered in the middle of each side wall, with a rectangular hole where the fingers fit to carry them in a comfortable way. Consequently, it also has an outer compartment, an empty rectangular outer support accessory in the middle, which is generated from one of the side walls parallel to the height of the smaller base of the container, generating a space to transport, for example, boxes with potato chips or native chips, tequeños, or spices, etc. In that way the side wall of the longer base has an extension of an outer face which is coupled to the inside of the longer base container, said attached face also has a rectangular hole to fill the napkin or complementary ingredients. Likewise, at the height of the upper surface, a spine is generated at the smaller base from corner to corner and in the middle of the spine it has two row cuts, at the height of the spine, creating a slit to insert a finger, so that at the moment of grabbing the container one gets better ergonomics when transporting it.

T12.4 Ergonomic Triple Inner Container with Handles

Container for food with multiple compartments with an incorporated drinks holder, ergonomic, characterized by containing a double compartment in the smaller base, it also considers a uniform height over the entire surface of the container. In this way, it considers a double height proportion elevation of the parallel side walls, consequently, in the middle of this elevation a mini handle is considered in the middle of each side face, with a rectangular hole where the fingers fit to take them in a comfortable way. In that way the side wall of the longer base has an extension of an outer face which is coupled to the inside of the longer base container, said attached face also has a rectangular hole to fill the napkin or complementary ingredients. Likewise, at the height of the upper surface, a spine is generated at the smaller base from corner to corner and in the middle of the spine it has two row cuts at the height of the spine, creating, a slit to insert a finger, so that at the moment of grabbing the container one gets better ergonomics when transporting it.

T13.5 Ergonomic Triple Pop Corn Container

Container for food with multiple compartments with an incorporated drinks holder, ergonomic, characterized by the elevation of the main compartment in proportion to the amount of food that is desired to introduce foods such as: popcorn, or some other snack, etc. It also contains an additional compartment next to the incorporated drinks holder. Likewise, at the height of the upper surface, a spine is generated at the smaller base from corner to corner and in the middle of the spine it has two row cuts at the height of the spine, creating a slit to insert a finger, so that at the moment of grabbing the container one gets better ergonomics when transporting it.

T14.6 Ergonomic Triple Barbecue Container

Container for food with multiple compartments with an incorporated drinks holder, ergonomic, characterized by the decrease in the height of the main compartment. It also contains an additional compartment next to the incorporated drinks holder. Likewise, at the height of the upper surface, a spine is generated at the smaller base from corner to corner and in the middle of the spine it has two row cuts at the height of the spine, creating a slit to insert a finger, so that at the moment of grabbing the container one gets better ergonomics when transporting it.

T15.7 Ergonomic Triple Hiper Container

Container for food with multiple compartments with an incorporated drinks holder, ergonomic, characterized by containing spaces of greater proportion, it also considers a uniform height over the entire surface of the container. It also contains an additional compartment next to the incorporated drinks holder. In that way the side wall of the longer base has an extension of an outer face which is coupled to the inside of the longer base container, said attached face also has a rectangular hole to fill the napkin or complementary ingredients. Likewise, at the height of the upper surface, a spine is generated at the smaller base from corner to corner and in the middle of the spine it has two row cuts at the height of the spine, creating a slit to insert a finger, so that at the moment of grabbing the container one gets better ergonomics when transporting it.

T16.8 Ergonomic Triple Happy Meal Container

Container for food with multiple compartments with an incorporated drinks holder, ergonomic, characterized by covering the entire container keeping all the food inside it. It also considers a double height proportion elevation of the parallel side walls, consequently, in the middle of this elevation a mini handle is considered in the middle of each side face, with a rectangular hole where the fingers fit to take them in, a comfortable way. In that way the side wall of the longer base has an extension of an outer face which is coupled to the inside of the longer base container, said attached face also has a rectangular hole to fill the napkin or complementary ingredients. Likewise, at the height of the upper surface, a spine is generated at the smaller base from corner to corner and in the middle of the spine it has two row cuts at the height of the spine, creating a slit to insert a finger, so that at the moment of grabbing the container one gets better ergonomics when transporting it.

T17.9 Ergonomic Simple Quadruple Container

Container for food with multiple compartments with an incorporated drinks holder, ergonomic, characterized by containing spaces of greater proportion, it also considers a uniform height over the entire surface of the container. It also contains an additional compartment next to the incorporated drinks holder and another in the main compartment. In that way the side wall of the longer base has an extension of an outer face which is coupled to the inside of the longer base container, said attached face also has a rectangular hole to fill the napkin or complementary ingredients. Likewise, at the height of the upper surface, a spine is generated at the smaller base from corner to corner and in the middle of the spine it has two row cuts at the height of the spine, creating a slit to insert a finger, so that at the moment of grabbing the container one gets better ergonomics when transporting it.

Thus concluding the practical use of these inventions in some references of centers of greater concurrence, detailed for each of them.

"Vending" sale of food and drinks: S1.1

Food trucks: S2.2; S3.3; D4.1; D5.2; D7.4: D8.5; T9.1; T10.2

Pastry: D6.3

Cinema: T13.5

Anticuchos—Burgers: T14.6

Chicken—Nuggets: T11.3; T12.4; T15.7; T16.8; T17.9

The product obtained from the present invention "Container for food with multiple compartments with an incorporated drinks holder" is especially applied in the Food Trucks sector, fast food centers, establishments that sell food on-the-go, restaurants, cinemas, theaters, pastry, events and home use.

The invention claimed is:

1. A container for food and drinks having multiple compartments and an incorporated drinks holder, said container comprising: a longer base comprising a lower support surface attached to four side walls attached to each other; and a smaller base comprising an upper surface and two "A"-tabs, said "A"-tabs being an extension of said upper surface, each located on opposite edges of the upper surface, in which the upper surface has a separating face which is an extension of the upper surface and is provided with a "D"-tab in the middle of an outer edge of the separating face and with "F"-tabs located on the left side and right side of said face, wherein the upper surface of the container consists around a die-cut sub edge into which it comprises a first cut and a die-cut crossed from corner to corner, materializing four triangles that generate pressure when inserting a cup and wherein said side walls have an inward inclination that allows said inserted cup to touch said side walls, wherein the longer base further comprises an outer face that is an extension generated from one of the side walls and that comprises a first rectangular hole and wherein said bases are joined by means of a spine whose first end is attached to the side wall opposite to the outer face of the longer base, and whose second end is attached to the edge opposite the separating face of the smaller base.

* * * * *